US006543458B1

(12) United States Patent
Ohba

(10) Patent No.: US 6,543,458 B1
(45) Date of Patent: Apr. 8, 2003

(54) MAKE-UP MATERIAL CONTAINER

(75) Inventor: Atsushi Ohba, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/831,383

(22) PCT Filed: Jun. 9, 2000

(86) PCT No.: PCT/JP00/03774

§ 371 (c)(1),
(2), (4) Date: May 9, 2001

(87) PCT Pub. No.: WO00/76367

PCT Pub. Date: Dec. 21, 2000

(30) Foreign Application Priority Data

Jun. 11, 1999 (JP) ..... 11-165622

(51) Int. Cl.[7] ..... A45D 40/26; A45D 40/24; A46B 11/00

(52) U.S. Cl. ..... 132/218; 132/317; 401/122; 401/126

(58) Field of Search ..... 132/218, 317, 132/320, 318; 401/122, 126, 127, 129, 123

(56) References Cited

U.S. PATENT DOCUMENTS 4,437,477 A * 3/1984 Gueret ..... 132/218
5,109,877 A * 5/1992 Takeda ..... 132/218
5,832,942 A * 11/1998 Gutberlet ..... 132/317
6,082,918 A * 7/2000 Gueret ..... 401/126
6,142,692 A * 11/2000 Garcia ..... 401/122

FOREIGN PATENT DOCUMENTS

| | | |
|---|---|---|
| JP | 78553/1985 | 12/1986 |
| JP | 11-56460 | 3/1999 |
| JP | 11-127953 | 5/1999 |

* cited by examiner

*Primary Examiner*—John J. Wilson
*Assistant Examiner*—Robyn Kieu Doan
(74) *Attorney, Agent, or Firm*—Rabin & Berdo, PC

(57) ABSTRACT

A cosmetic container serves both as a container for containing a liquid cosmetic and a stick type cosmetic material container for housing a stick type cosmetic material in such a manner that the stick type cosmetic material can be fed out. Thus, a container body in which a liquid cosmetic is filled is spirally engaged with a junction tool which freely opens and closes the container body. A stick type pivot which is inserted in the container body and has an applicator is fixed to the junction tool. A front cylinder is rotatably connected to the junction tool. A feeding mechanism for moving in an axial direction a rod, which retains the stick type cosmetic material to be slidably inserted in the front cylinder, by rotations of the junction tool and the front cylinder is provided.

10 Claims, 12 Drawing Sheets

MAKE-UP MATERIAL CONTAINER

TECHNICAL FIELD

The present invention relates to a cosmetic container which contains both liquid cosmetics and the pertinent stick type cosmetic materials.

BACKGROUND ART

A suitable amount of liquid cosmetic represented by mascara, manicure, lip-gloss, or the like is put on a stick type applicator fixed to a cap. Then, in the case of the mascara, it is applied to eyelashes. In the case of the lip-gloss, it is applied to lips. And in the case of the manicure, it is applied to nails. Generally, this type of makeup is widespread. However, usually, in the case of a makeup on the eyes, eyeliner, eyebrow pencil, and the like are applied in addition to mascara, and in the case of makeup on the lips, lipstick and lipliner are applied in addition to lip-gloss. In other words, stick type cosmetic materials and liquid cosmetics are usually used in combination. Thus, several kinds of cosmetic materials have to be prepared for such a partial makeup, thereby requiring much labor.

Further, if a user is carrying such cosmetic materials while the user is out, these liquid cosmetics and stick type cosmetic materials will be bulky in a small cosmetic pochette or the like. Moreover, the user has to carry several kinds of stick type cosmetic materials including those for repairing the makeup or spare cosmetic materials which are of different colors, thereby requiring the labor to search.

An object of the present invention is to get rid of such problems.

The present invention is directed to provide a cosmetic container which is devised for convenient use by housing a liquid cosmetic on one side and a stick type cosmetic material of high frequency on the opposite side in such a manner that the stick type cosmetic material can be fed out.

The present invention enables double storage of a stick type cosmetic material and a liquid cosmetic in which a color of a similar shade is combined, for example a combination of black mascara and black eyeliner or eyebrow pencil or a combination of red lip-gloss and red lipliner or the like, or various colors are combined for the pursuit of fashion, whereby the convenient use of cosmetics can be enhanced.

DISCLOSURE OF THE INVENTION

In order to achieve the objects mentioned above, a cosmetic container according to the present invention provides a container body in which a liquid cosmetic is filled up; a junction tool which is spirally engaged with a mouth of the container body and freely opens and closes the container body; a stick type pivot which is fixed to the junction tool, can be inserted into the container body, and has an applicator; a front cylinder rotatably connected with the junction tool and having at its front end an opening hole through which a stick type cosmetic material penetrates; a rod which has a retaining section for retaining a base end of the stick type cosmetic material slidably inserted in the front cylinder; and a feeding mechanism for moving the rod in axial direction by rotations of the junction tool and the front cylinder.

Also, preferably in the present invention, a first fitting section for connecting the stick type pivot is installed on the lower side of the junction tool and a second fitting section for rotatably connecting the front cylinder is installed on the upper side of the junction tool.

More preferably, in the present invention, a spiral groove formed on the lower side of the junction tool is spirally engaged with a male screw provided at a mouth of the container body in such a manner that the spiral groove can freely be attached and detached, a spiral section provided at the rod is spirally engaged with a spiral groove provided on the upper side of the junction tool so as to constitute a spiral engagement mechanism, there is provided a sliding mechanism for guiding the rod in such a manner that the rod cannot rotate, but can slide with respect to the inside of the front cylinder, and these spiral engagement mechanism and sliding mechanism constitute the feeding mechanism.

More preferably, in the present invention, a spiral body having a spiral groove at its inner circumference is inserted into and fixed to an upper part of the junction groove, and the spiral body and the spiral section of the rod are spirally engaged.

More preferably, the present invention is constituted such that spiral directions of the spiral groove on the upper side of the junction tool and the spiral groove on the lower side of the junction tool are identical.

More preferably, the present invention is constituted such that spiral directions of the spiral groove on the upper side of the junction tool and the spiral groove on the lower side of the junction tool are different each other.

More preferably, in the present invention, a partition section for separating the junction tool into an upper cavity section and a lower cavity section is provided in the junction tool.

More preferably, in the present invention, a squeezing rubber which has a hole for squeezing liquid cosmetics attached to the applicator is provided at an entry section of the container body.

In the cosmetic container according to the present invention, the container body in which a prescribed amount of liquid cosmetic is filled up is spirally connected on the lower side in such a manner that the container body can freely open and close, and the front cylinder having an opening hole through which the stick type cosmetic material is fed out is rotatably connected on the upper side on the basis of the location of the junction tool which has openings on its upper and lower sides.

At the time of installation of the container body in which a liquid cosmetic is contained, the applicator provided at a tip of the container body is always soaked in the liquid cosmetic contained. At the time of use, airtightness of the container body resulting from spiral engagement of the male screw at the mouth of the container body with the junction tool is released by rotations of the junction tool and the container body, and the liquid cosmetic attached to the applicator is used. Incidentally, before using the liquid cosmetic, quantity of the liquid attached can be adjusted according to user's preference by squeezing the applicator using the squeezing rubber arranged at the mouth of the container body.

Further, the stick type cosmetic material provided on the upper side of the junction tool is used, the front cylinder and the junction tool or the container body are rotated in a prescribed direction.

In the front cylinder serving as a stick type cosmetic material feeding container, a stick type cosmetic material feeding mechanism is constituted by a sliding mechanism for guiding the rod in so that the rod cannot rotate, but can slide and a spiral engagement mechanism composed of a second spiral groove provided at an upper part of the junction tool and a spiral section of the rod which is spirally engaged with the second spiral groove.

Therefore, the rod is moved in an axial direction by the feeding mechanism with the progress of the rotations described above and the stick type cosmetic material retained at a tip of the rod is fed out through an opening hole provided at a tip of the front cylinder, whereby the stick type cosmetic material can be used in a state that it is fed out by a required amount.

On the contrary, when the stick type cosmetic material is drawn into an original position, it will be satisfactory if the junction tool or the container body is rotated in a direction reverse to the direction described above with respect to the front cylinder.

In the present invention, it is possible to use the container body in which the liquid cosmetic is filled and the front cylinder serving as a stick type cosmetic material feeding container at both ends on the basis of the position of the junction tool as described above. Further, as a feature, the present invention includes in the junction tool all the mechanisms which make connection with each member, such as a first spiral groove which opens and closes the container body resulting from spiral engagement with the male screw at the mouth of the container body, a first concave annular groove serving as a first fitting section for fixing the stick type pivot which the applicator is arranged at its tip, the second spiral groove which is spirally engaged with the rod and constitutes the spiral engagement mechanism, and a second concave annular groove serving as a second fitting section which allows the front cylinder to rotatably fit in.

Thus, even though components are minimum, it is possible to simultaneously fit two types of cosmetic materials to a single junction tool and employee the cosmetic materials utilizing functions in the junction tool.

Further, by forming as a separate member only the second spiral groove which carries out a spiral engagement function of the front cylinder serving as a stick type cosmetic material feeding container, it is also possible to achieve facilitation and efficiency in manufacture.

BEST MODE FOR CARRYING OUT THE INVENTION

A more detailed description of a cosmetic container according to the present invention will subsequently be given with reference to the accompanying drawings.

Figure 1:
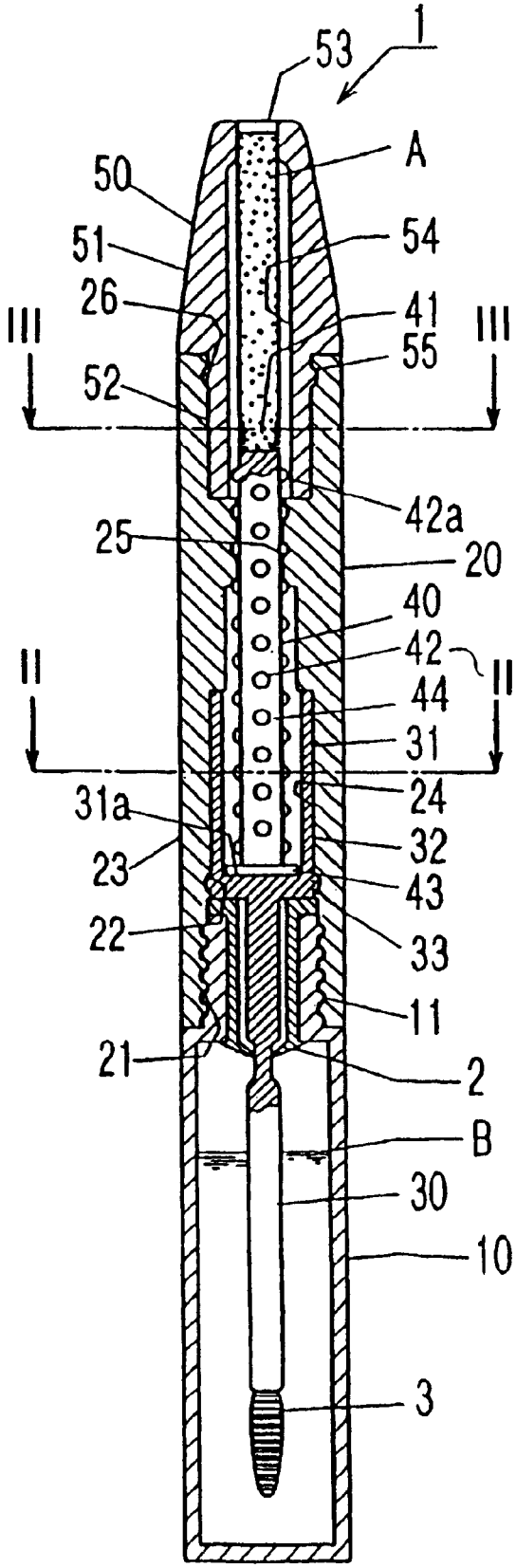
FIG. 1 is a partially longitudinal section showing a cosmetic container according to a first embodiment of the present invention.
Figure 2:
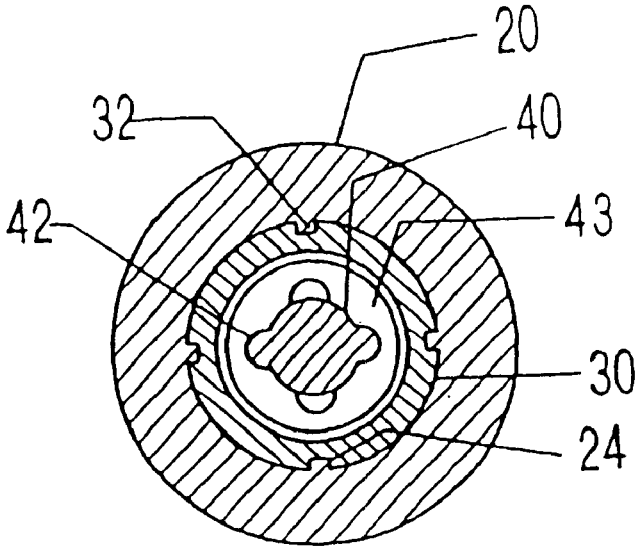
FIG. 2 is a sectional view taken along line I—I of FIG. 1.
Figure 3:
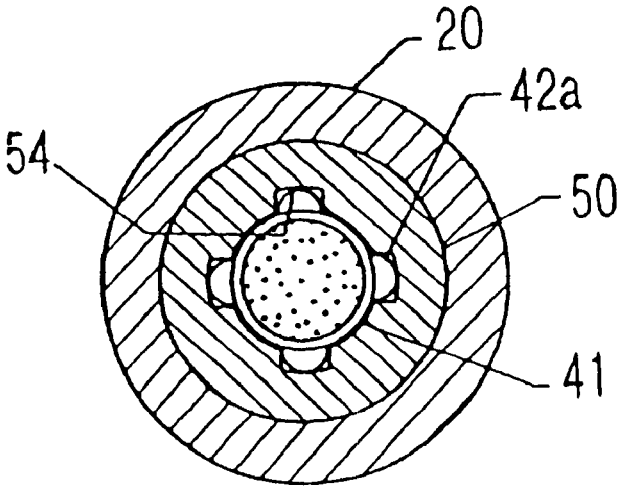
FIG. 3 is a sectional view taken along line II—II of FIG. 1.
Figure 4:
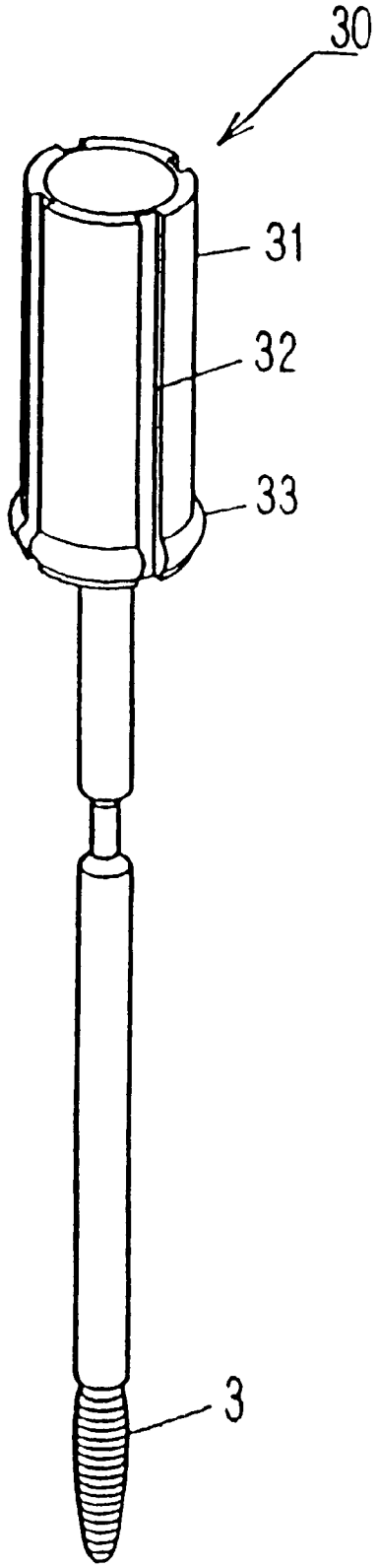
FIG. 4 is a perspective view showing a stick type pivot which is used in the first embodiment shown in FIG. 1.

FIG. 1 is a longitudinal sectional view showing a cosmetic container 1 according to a first embodiment of the present invention, and the cosmetic container 1 is composed of a container body 10, a junction tool 20, a stick type pivot 30, a rod 40, and a front cylinder 50. FIG. 2 is a sectional view taken along line I—I of FIG. 1. FIG. 3 is a sectional view taken along line II—II. FIG. 4 is a perspective view showing the stick type pivot 30 which is used in this embodiment.

First, a description will begin with respect to a longitudinal sectional view shown in FIG. 1. The container body 10 is a blow molding cylindrical body having a bottom in which a liquid type cosmetic (B) is filled, and a male screw for sealing up the liquid type cosmetic (B) by spiral engagement with the junction tool 20 is arranged at a mouth of the front section of the container body 10. FIG. 1 is shown on the assumption that a container body for mascara and a stick type cosmetic material are used. Thus, a conic squeezing rubber 2 having a center hole is installed at a mouth of the container body 10, and the amount of liquid adhered is adjusted by squeezing an outer circumference of a brush 3 (applicator) which is provided at a tip of the stick type pivot 30 fixed to the junction tool 20.

In FIG. 1, the junction tool 20 is a hollow cylindrical body. A first spiral groove 21, for sealing the container body 10 described above by spiral engagement with the male screw 11 at the mouth of the container body 10, is formed at an inner circumference on the lower side of the junction tool 20. A first fitting concave annular section 22 (first fitting section) to which the stick type pivot 30 is fixed by engagement is provided above the first spiral groove 21, and a plurality of engagement line sections 24 to be engaged with the stick type pivot 30 are installed at a small diameter section 23 which is above the first fitting concave annular section 22 as shown in detail in FIG. 2. A second spiral groove 25 to be used as a stick type cosmetic material feeding mechanism is arranged above the engagement line sections 24. A second fitting concave annular section 26 (second fitting section) to be rotatably connected with the front cylinder 50 serving as a stick type cosmetic material feeding container is installed above the second spiral groove 25.

The front cylinder 50 is rotatably connected with the second fitting concave annular section 26 provided at an upper part of the junction tool 20. The front cylinder 50 is composed of an exposed section 51 exposed outside and a rotary section 52 to be housed in the junction tool 20. A tip opening hole 53 through which a stick type cosmetic material (A) advances and retreats is provided at the center of a front end of the exposed section 51. On an inner circumferential surface of the front cylinder 50, there are provided engagement projections 42a of the rod 40 to be described later which are located above the second spiral groove 25 and a slide groove 54 in which the engagement projections 42 above a rod shaft section 44 slide when the engagement projections 42 are fed out. A fitting convex section 55 to be engaged with the second fitting concave annular section 26 of the junction tool 20 is arranged at an upper outer circumference of the rotary section 52.

The engagement projections 42*a* on a front end side of the rod 40 are arranged as a file of projections which form a virtual spiral space, together with a plurality of engagement projections 42 which follow the engagement projections 42*a*. The engagement projections 42*a* and the engagement projections 42 form a spiral section of the rod 40, and the engagement sections 42 among them are spirally engaged with the second spiral groove 25, thereby constituting a spiral engagement mechanism.

As described above, the rod 40 is inserted in the front cylinder 50 and a stick type cosmetic material retaining section 41 for retaining a tail section of the stick type cosmetic material (A) has the shape of a cup at a front section of the rod 40. Also, the engagement projections 42*a* are engaged with the slide groove 54, which extends in an axial direction, on an inner circumferential surface of the front cylinder 50, thereby constituting a sliding mechanism for guiding the rod 40 in such a manner that the rod 40 cannot rotate, but can slide.

A plurality of engagement projections 42 which are spirally engaged with the second spiral groove 25 of the junction tool 20 are arranged over an outer circumference of the rod shaft section 44 of the rod 40 and a flange 43 which defines a feeding uppermost limit is formed at a rear end of the rod 40.

As clearly shown in FIG. 3, the engagement projections 42*a* are engaged with the slide groove 54 of the front cylinder 50 and always play a role of regulating rotations of the rod 40 and the front cylinder 50. With the progress of sliding of the rod 40 when fed out, the engagement projections 42 on the rod shaft section 44 are engaged with the slide groove 54 of the front cylinder 50 one after another and play a role in the regulation of rotations subsequently to the engagement projections 42*a* at the front end.

In other words, due to the feeding mechanism which is constituted by the spiral engagement mechanism and the sliding mechanism, the rod 40 can feed out the stick type cosmetic material (A).

With regard to the stick type pivot 30 on the side of the container body 10, as shown in FIG. 4, the brush 3 is fixed to its front end, and its base end side is a hollow cylindrical body 31. An engagement groove 32 which is engaged with the engagement line section 24, thereby making the stick type pivot 30 and the junction tool 20 unrotatable is provided at an outer circumference of the cylindrical body 31. Further, a fitting convex section 33 is fixed to the first fitting concave annular section 22 of the junction tool 20, whereby the fitting convex section 33 is connected with the junction tool 20 as one body.

Incidentally, in FIG. 1, a bottom surface 31 a of the cylindrical body 31 of the stick type pivot 30 comes into contact with the flange 43 provided at a rear end of the rod 40 which constitutes the stick type cosmetic material feeding mechanism on the upper side, whereby the bottom surface 31*a* becomes a retreating lowermost limit.

In the cosmetic container 1 constituted as described above, when the liquid type cosmetic (B) is used, by rotating the junction tool 20 with respect to the container body 10, spiral engagement of the both is released. By drawing the stick type pivot 30 fixed to the junction tool 20, an outer circumference of the brush 3 to which the liquid type cosmetic (B) is adhered and which is fixed to a tip of the stick type pivot 30 is squeezed by the squeezing rubber 2, whereby it is possible to apply to eyelashes or the like for a makeup the liquid type cosmetic (B) whose liquid quantity adhered is appropriately adjusted. By sealing the container body 10 resulting from spiral engagement of the junction tool 20 with the container body 10 after using the liquid type cosmetic (B), the liquid type cosmetic (B) is prevented from evaporating.

In using the stick type cosmetic material (A) on the upper side and in an axial direction of the cosmetic container 1, if the front cylinder 50 is rotated with the container body 10 or the junction tool 20 being held by hand, the feeding mechanism will be actuated and the rod 40 at the retreating lowermost limit will advance rotating synchronously with the front cylinder 50 because the front cylinder 50 and the rod 40 cannot rotate, but can slide and the engagement projections 42 provided in an axial direction of the rod 40 are spirally engaged with the second spiral groove 25 provided on the upper side of the junction tool 20. Thus, it is possible to advance the stick type cosmetic material (A) from the tip opening hole 53 of the front cylinder 50. Further, if the front cylinder 50 is reversely rotated, the stick type cosmetic material (A) will retreat and return to the inside of the front cylinder 50.

A feature of this embodiment shown in FIG. 1 is that the first spiral groove 21 which is spirally engaged with the male screw 11 provided at a mouth of the container body 10 is provided on the lower side of the inside of the junction tool 20 and the second spiral groove 25 to be used as a mechanism for feeding the stick type cosmetic material A is provided on the upper side of the inside of the junction tool 20. This embodiment is further characterized in that the first fitting concave annular section 22 to which the stick type pivot 30 is fixed is formed on the lower side of the junction tool 20 and the second fitting concave annular section 26 which rotatably retains the front cylinder 50 is formed on the upper side of the junction tool 20.

In FIG. 1, the junction tool 20 is formed to be a hollow cylinder, and a retreating lowermost limit of the stick type cosmetic material (A) in the front cylinder 50 is defined when the flange 43 of the rod 40 comes into contact with the inside diameter bottom surface 31*a* of the cylindrical body 31 on the base end side of the stick type pivot 30.

The cosmetic container 1 shown in FIG. 1 is assembled in the following procedures.

First, the rod 40 is inserted from the side of the first spiral groove 21 provided on the lower side of the junction tool 20 with the stick type cosmetic material retaining section 41 being at the head, and the rod 40 is advanced while the engagement projections 42 are spirally engaged with the second spiral groove 25. Next, the stick type pivot 30 to which the brush 3 is fixed is inserted into the first spiral groove 21 of the junction tool 20 from the side of the cylindrical body 31, and the stick type pivot 30 is inserted into the junction tool 20 by engaging the engagement groove 32 provided at an outer circumference of the cylindrical body 31 of the stick type pivot 30 with the engagement line section 24 of the junction tool 20. The stick type pivot 30 is then fixed to the junction tool 20 by fitting the fitting convex section 33 provided at an outer circumference of the cylindrical body 31 of the stick type pivot 30 into the first fitting concave annular section 22 of the junction tool 20.

Next, the front cylinder 50 is inserted from the upper side of the junction tool 20 while the engagement projections 42*a* provided on the rod 40 are engaged with the slide groove 54. The fitting convex section 55 at an outer circumference of the front cylinder 50 is fitted into the second fitting concave annular section 26 on the upper side of the junction tool 20, and the front cylinder 50 is rotatably connected to the junction tool 20.

The container body 10 is a cylindrical body having a bottom which is produced by blow molding or the like as described above, and the container body 10 has at its front part the male screw 11 to be used for spiral engagement with the junction tool 20.

The squeezing rubber 2 made of an NBR (butadiene-acrylonitrile rubber) or the like has a hole in the center and it is used for squeezing an outer circumference of the brush 3 provided at a tip of the stick type pivot 30. It is possible to easily install the squeezing rubber 2 at the mouth of the container body 10.

After the assembly carried out in such a manner, the liquid type cosmetic (B) is filled in the container body 10, further the stick type cosmetic material (A) is installed at the stick type cosmetic material retaining section 41 from the upper side, and the junction tool 20 is spirally engaged with the container body 10 so as to seal the container body 10, which completes the cosmetic container 1.

The cosmetic container 1 shown in FIG. 1 is presented on the assumption that mascara and eyeliner or eyebrow pencil are used.

Next, a second embodiment will be described.

Figure 5:
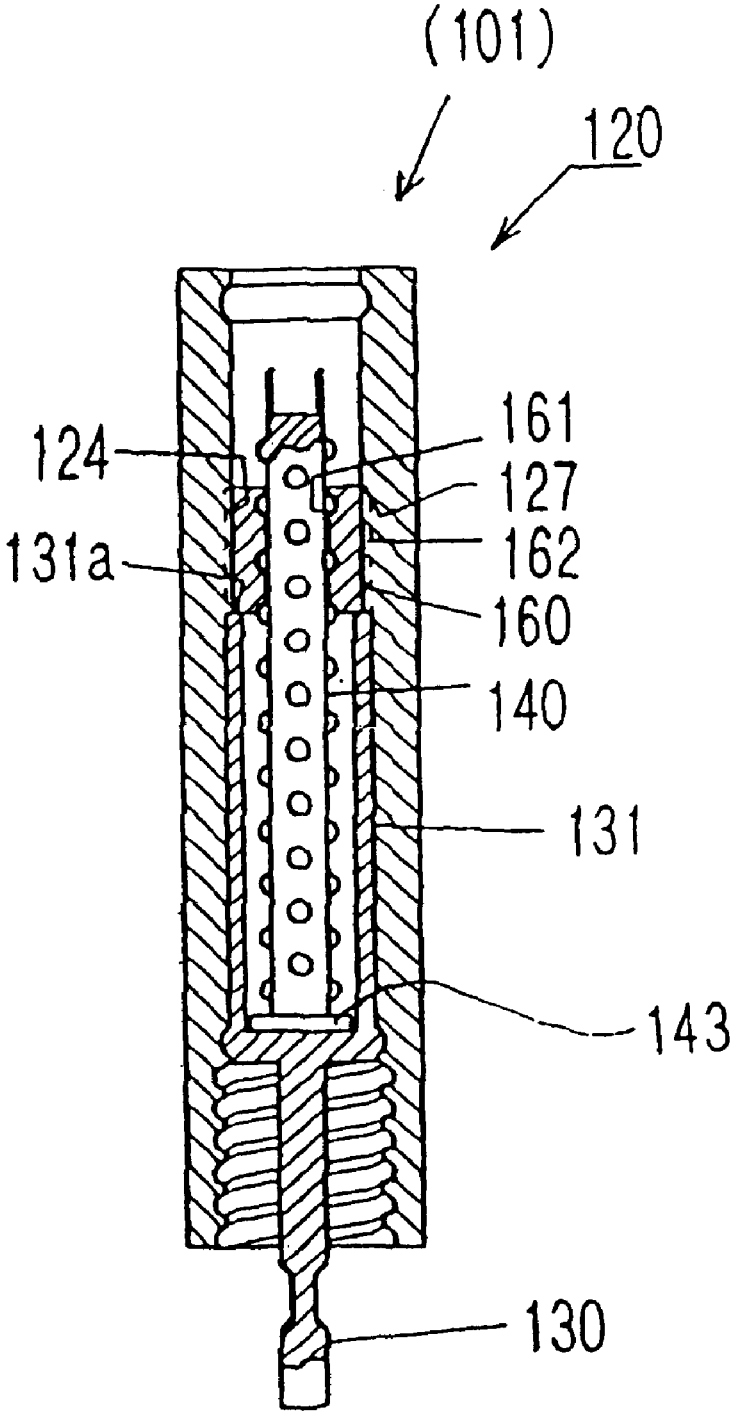
FIG. 5 is a partially longitudinal section showing a relationship among a junction tool, a rod, a spiral body, and a stick type pivot of a cosmetic container according to a second embodiment of the present invention.
Figure 6:
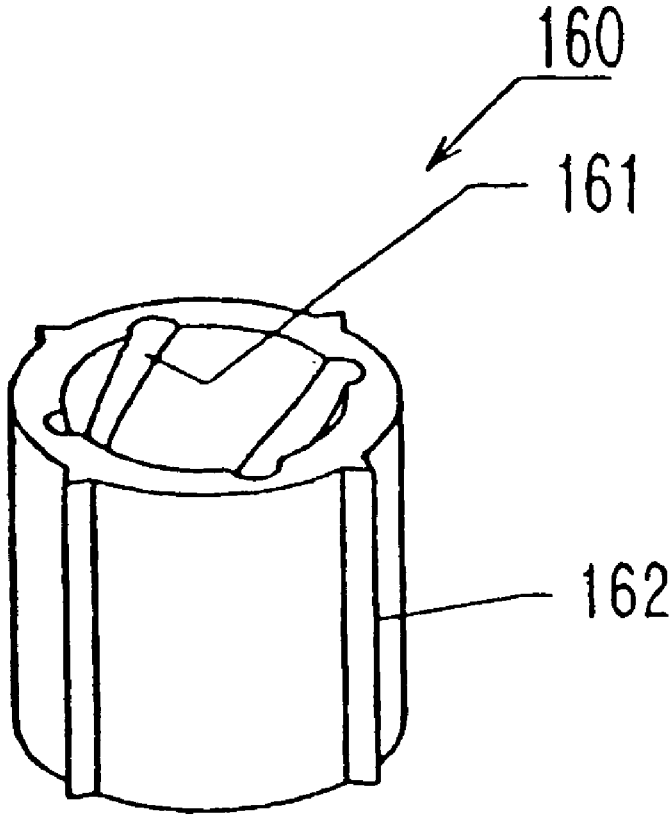
FIG. 6 is a perspective showing the spiral body which is used in the second embodiment shown in FIG. 5.

A longitudinal sectional view of FIG. 5 shows a junction tool 120 of a cosmetic container 101 according to the second embodiment of the present invention. Here, it is arranged such that instead of directly equipping the junction tool 20 with the second spiral groove 25 as shown in FIG. 1, a spiral body 160 in which a spiral groove 161 is arranged at its inner circumference shown in detail in FIG. 6 is installed as a separate body.

In the case of FIG. 1, the junction tool 20 is characterized in that the first spiral groove 21, the first fitting concave annular section 22, the second spiral groove 25, and the second fitting concave annular section 26 are simultaneously manufactured and all of them are arranged in the junction tool 20 which is a single member. It is best that the cosmetic container is composed of few members like the above, but it is possible to be efficient in assembling and manufacturing the components by increasing the number of the members.

In FIG. 5, the spiral groove 161 of the spiral body 160 and a spiral section of a rod 140 which are spirally engaged are inserted from the lower side of the junction tool 120 similarly to FIG. 1. As it is clear from FIG. 6, a plurality of engagement vertical ribs 162 are arranged at an outer circumference of the spiral body 160 and they play a role in the regulation of rotations by engaging with an engagement line section 124 provided in the junction tool 120. The spiral body 160 is retained between a top face 131*a* of a cylindrical body 131 provided at an upper part of a stick type pivot 130 and a step section 127 provided at an upper part of the inside of the junction tool 120, and a front cylinder is rotatably connected with a tip of the junction tool 120 similarly to FIG. 1.

In such a manner, a first spiral groove 121 is enough for the spiral groove of the junction tool 120, thereby facilitating manufacture of the junction tool 120.

Further, a third embodiment will be described.

Figure 7:
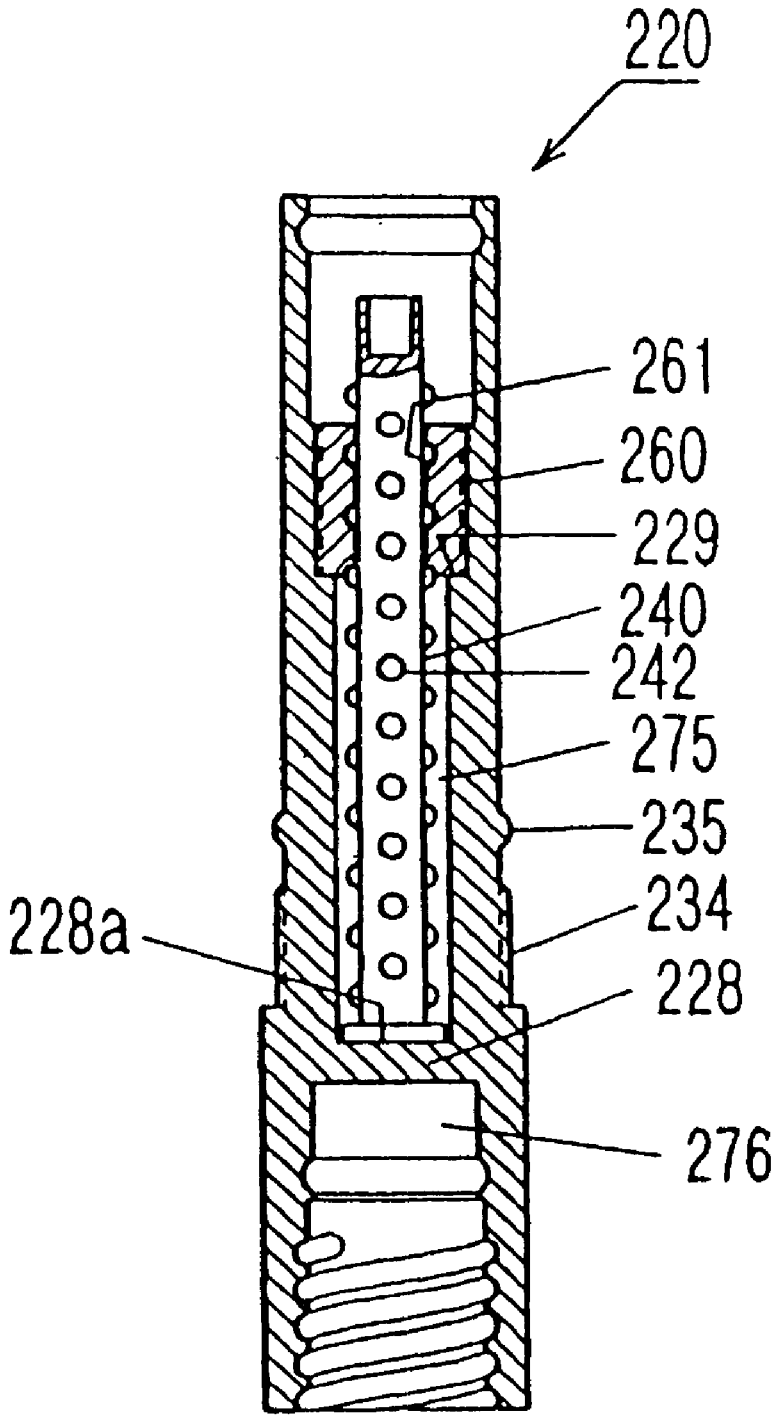
FIG. 7 is a partially longitudinal section showing a junction tool of a cosmetic container according to a third embodiment of the present invention.
Figure 8:
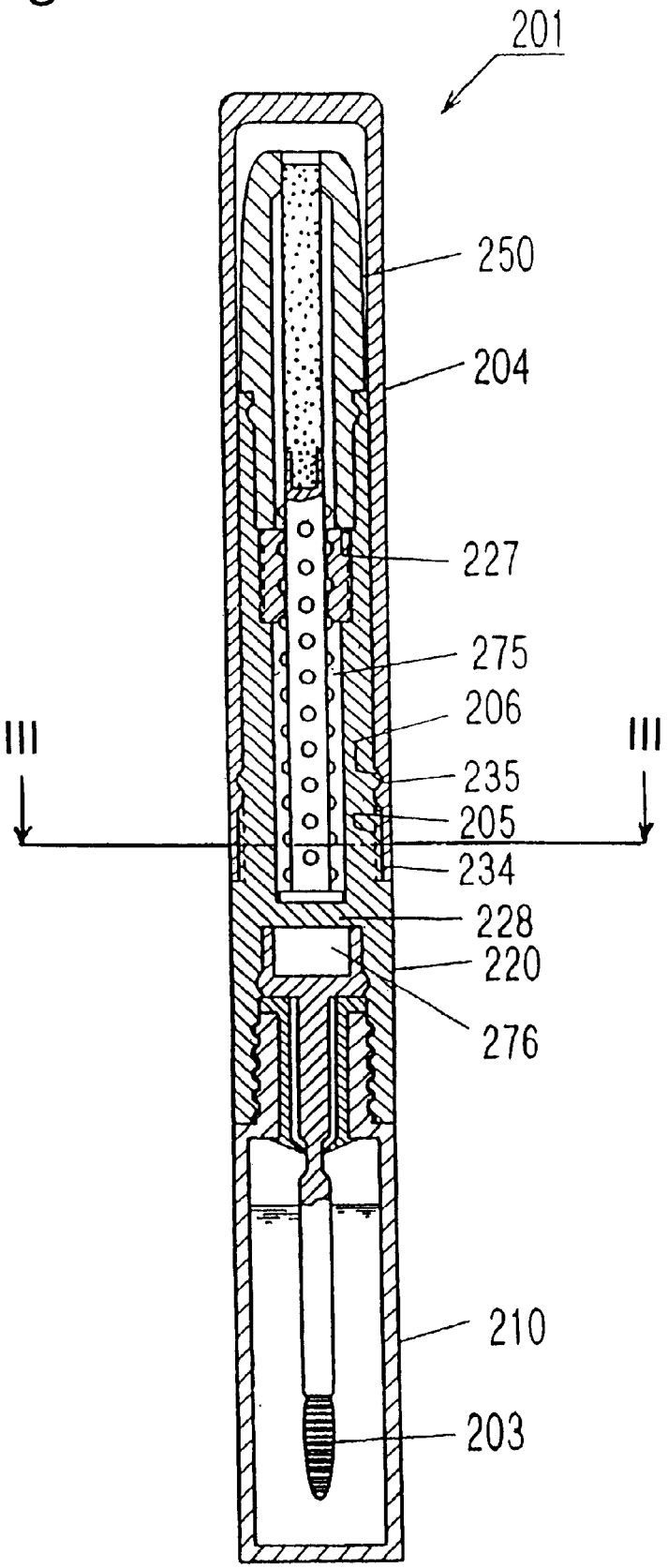
FIG. 8 is a partially longitudinal section showing the cosmetic container according to the third embodiment of the present invention.

FIG. 7 shows a junction tool 220 and FIG. 8 shows entire constitution of a cosmetic container 201. As it is clear from FIG. 7, in this embodiment, the constitution is such that the junction tool 220 is partitioned halfway so as to have an upper cavity section 275 and a lower cavity section 276.

In FIGS. 1 and 5, retreating lowermost limits of the rods 40 and 140 are defined when the flanges 43 and 143 of the rods 40 and 140 come into contact with inside diameter bottom surfaces of the cylindrical bodies 31 and 131 of the stick type pivots 30 and 130, respectively. However, in this embodiment, a retreating lowermost limit of a rod 240 is defined when the rod 240 comes into contact with a top surface 228*a* of a partition board 228 provided in the junction tool 220, whereby it is not necessary to use the cylindrical body 31.

Further, the junction tool 220 is completely separated into the upper cavity section 275 and the lower cavity section 276 by the partition board 228 provided in the junction tool 220, whereby it is possible to provide a perfect sealing condition for the liquid type cosmetic (B) provided on the lower side and the partition board 228 becomes the retreating lowermost limit of the rod 240 for retaining the stick type cosmetic material (A) provided on the upper side. Thus, the cosmetic container 201 is more reliable in functionality than the cosmetic container 1 shown in FIG. 1.

In this case, a spiral body 260 which is a separate member is inserted from an upper part of the rod 240, and after engagement projections 242 (spiral section) on the rod 240 and a spiral groove 261 in the spiral body 260 are spirally engaged and assembled, they are inserted in the upper cavity section 275 from an upper opening of the junction tool 220. The spiral body 260 is retained between a step section 229 provided in the junction tool 220 and a lower end surface 227 of a front cylinder 250 shown in FIG. 8.

The cosmetic container 201 shown in FIG. 8 is presented on the assumption that lipliner and lip-gross which use the junction tool 220 in FIG. 7 described above will be contained. And a cap 204 is fitted to the junction tool 220 from outside the front cylinder 250 in such a manner that the cap 204 can be attached and detached.

Figure 9:
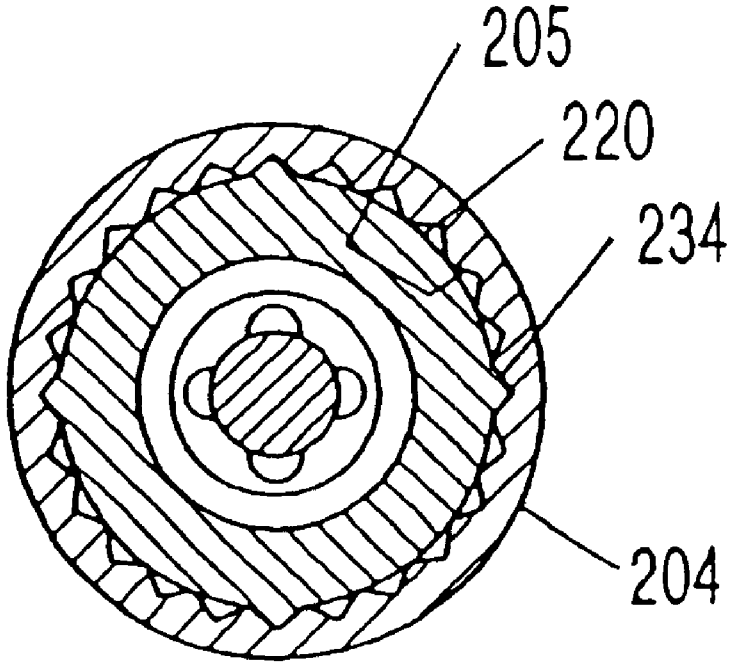
FIG. 9 is a sectional view taken along line III—III of FIG. 8.

A cap engagement concave section 206 and a spline 205 are formed at a lower part of the inner circumference of the cap 204 described above, and a cap engagement convex section 235 and a rib 234 which are engaged with the cap engagement concave section 206 and the spline 205, respectively, are formed on an outer circumferential surface of the junction tool 220. When the cap 204is installed at the junction tool 220, the cap engagement concave section 206 and the cap engagement convex section 235 are engaged and fixed in an axial direction. Further, the spline 205 and the rib 234 are engaged as shown in a sectional view taken along line III—III of FIG. 9, thereby constituting means for regulating the rotation around an axis.

Due to such constitution, the cap 204 and a container body 210 are relatively rotated and the junction tool 220 and an applicator (brush 203) are removed from the container body 210 in a state that the junction tool 220 is engaged with the cap 204, whereby the liquid type cosmetic can be used. Also, it is possible to prevent the junction tool 220 and the cap 204 from racing when the container body 210 and the cap 204 are held by hand and rotated relatively to each other.

Figure 10:
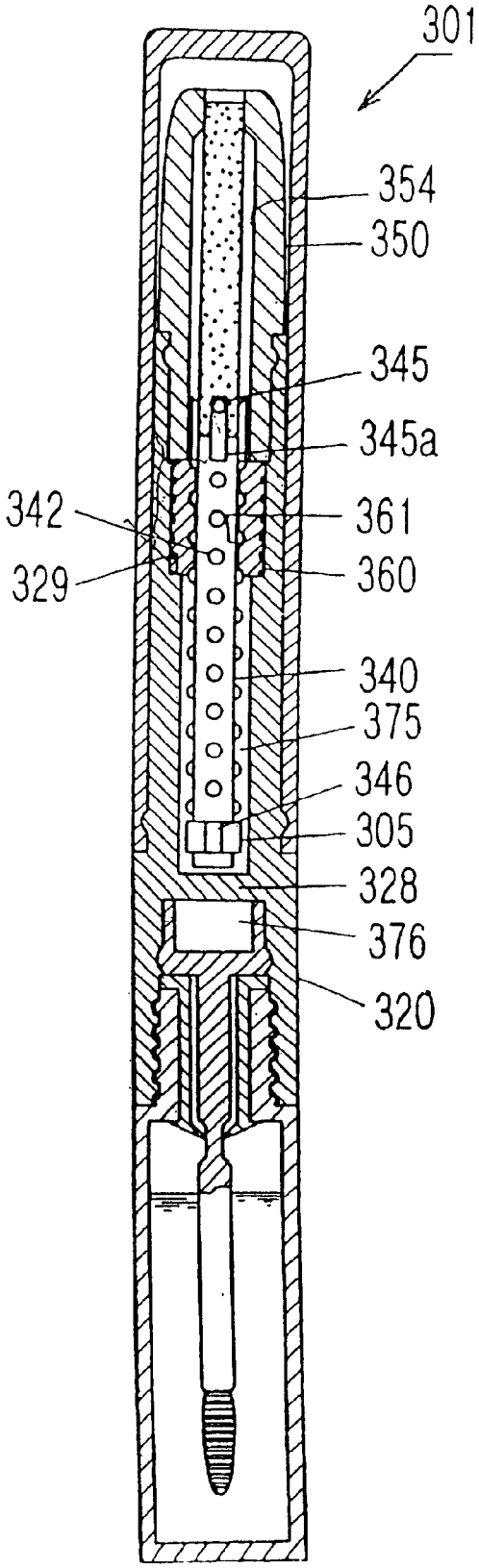
FIG. 10 is a partially longitudinal section showing a cosmetic container according to a fourth embodiment of the present invention.

What is shown in FIG. 10 is a cosmetic container 301 according to a fourth embodiment of the present invention, and it is a cosmetic container in which a junction tool 320 is separated into an upper cavity section 375 and a lower cavity section 376 by a partition board 328 similarly to the cosmetic container 201 of FIG. 8.

The fundamental constitution of the cosmetic container 301 according to this embodiment is almost same as that of the cosmetic container 201 shown in FIG. 8, but the following points differ.

First, in this embodiment, a cosmetic material retaining section arranged at a tip of a rod 340 does not have the cup-shaped structure as described above, but it is composed of a plurality of claws 345. At a lower part of the respective claws 345, there is provided a lower part projection 345*a* which is engaged with a slide groove 354 of a front cylinder 350 and plays a role in the regulation of rotations.

When the junction tool 320 and the front cylinder 350 are relatively rotated, due to spiral engagement of engagement projections 342 arranged on an outer circumferential surface of the axis of the rod 340 with a spiral groove 361 provided in a spiral body 360, the rod 340 advances in such a manner that both the lower part projection 345*a* whose width in a circumferential direction is equal to or wider than the respective claws 345 and engagement projections 342 slide one after another in the slide groove 354 formed in the front cylinder 350.

Further, this embodiment differs from the embodiments described above in the assembling method.

First, the rod 340 is inserted from an upper opening of the spiral body 360 while spirally engaging the rod 340 with the spiral groove 361 and then a stopper member 305 is fit to a straight surface 346 provided at a lower part of the rod 340, whereby a unit is constituted. By doing so, the spiral body 360 is retained in a state that the spiral body 360 is spirally engaged with the rod 340 between the stopper member 305 and the lower part projection 345*a* provided at a lower part of the respective claws 345, whereby the rod 340 and the stopper member 305 will never come off. Consequently, it is possible to provide a cosmetic container which is very stable and easy to assemble.

Subsequently, the unit assembled is inserted in the junction tool 320 and placed on a step section 329, and the front cylinder 350 is assembled, which completes the cosmetic container 301 shown in FIG. 10.

Figure 11:
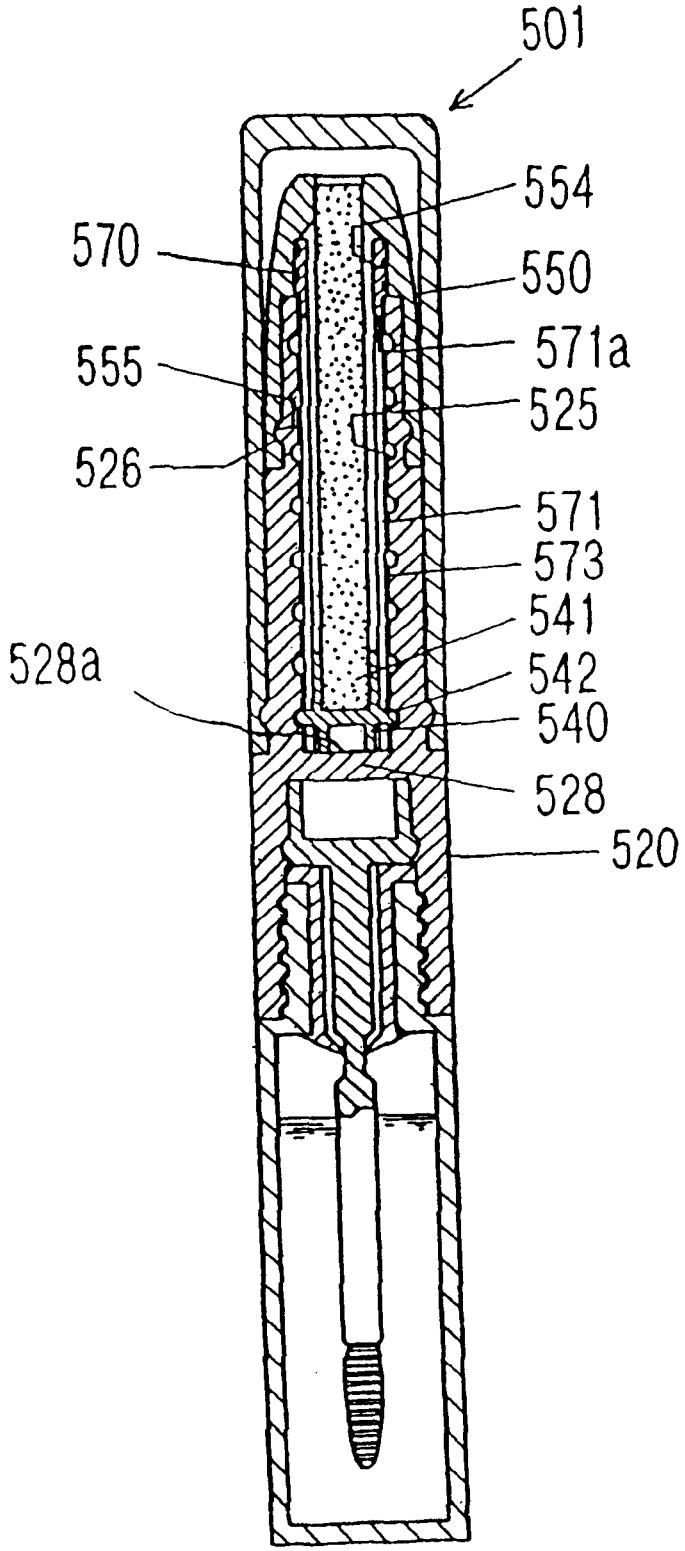
FIG. 11 is a partially longitudinal section showing a cosmetic container according to a fifth embodiment of the present invention.
Figure 12:
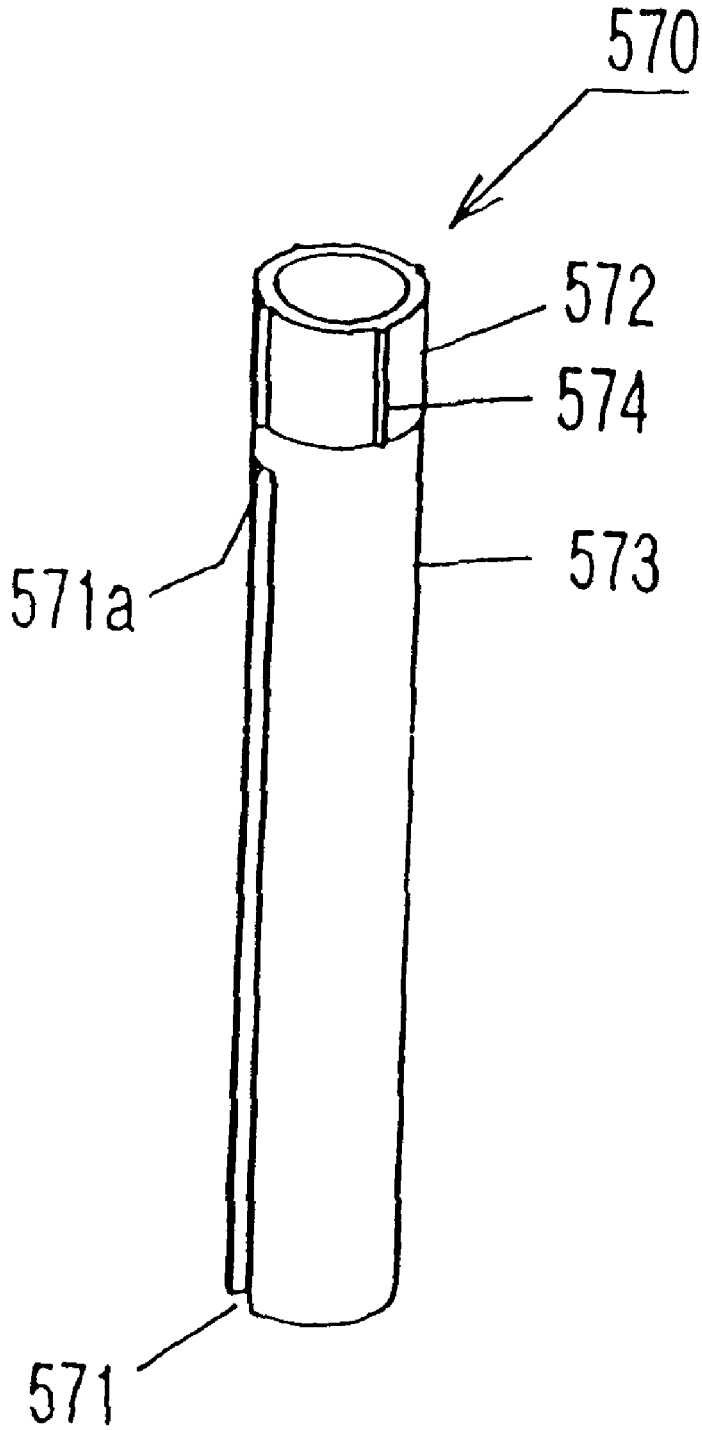
FIG. 12 is a perspective view showing a sliding cylinder in FIG. 11.

Next, what is shown in FIGS. 11 and 12 is a fifth embodiment of the present invention.

A feature of this embodiment will be explained. This embodiment is characterized in that a second spiral groove 525 which is longer than the stroke of the stick type cosmetic material (A) is formed on an inner circumferential surface above a partition section 528 and also a sliding cylinder 570 shown in FIG. 12 is installed in a junction tool 520.

When compared with the embodiment shown in FIG. 1, although the number of the parts increases, it is possible to design such that the rod extending from the stick type cosmetic material retaining section is shorter, whereby the total length of the container is shorter.

First, the sliding cylinder 570 shown in FIG. 12 will be explained. On an outer circumferential surface on the upper part side, there is provided a circular cylinder 572 on which a vertical rib 574 to be synchronously engaged with a circular cylinder engagement section 554 to be described hereinafter is formed. And a slit cylinder 573 is extended below the circular cylinder 572. At the slit cylinder 573, a slit 571 extending in a vertical direction is formed.

Next, the point which differs from the embodiment in FIG. 1 will be described with reference to FIG. 11. The difference is that the second spiral groove 525 is formed on all over the upper inner circumferential surface of the junction tool 520.

Further, a stick type cosmetic material retaining section 541 is formed at a short rod 540 and further a through projection 542 which goes through the slit 571 described above and is spirally engaged with the second spiral groove 525 is installed.

A fitting section 555 is engaged with a second fitting section 526 of the junction tool 520 in such a manner that a front cylinder 550 and the junction tool 520 cannot move in an axial direction, but can rotate. At an inner circumference of a tip section of the front cylinder 550, there is provided the circular cylinder engagement section 554 which is synchronously engaged with the vertical rib 574 described above.

Due to such constitution, when the front cylinder 550 is rotated (normal rotation) in a state that the junction tool 520 is fixed, the sliding cylinder 570 which is synchronously engaged, by means of the vertical rib 574, with the circular cylinder engagement section 554 provided at an inner circumference of the front cylinder 550 also starts rotating. At this time, also the rod 540 having the through projection 542 which goes through the slit 571 of the sliding cylinder 570 is guided by the slit 571 and starts rotating.

When the rod 540 is rotated, the rod 540 starts rising because the second spiral groove 525 provided on an inner circumferential surface of the junction tool 520 and the through projection 542 of the rod 540 are spirally engaged, and the rod 540 rises until the through projection 542 comes into contact with a slit upper end 571*a* of the slit 571, which is the uppermost limit of the stick type cosmetic material (A).

Next, when the front cylinder 550 is reversely rotated in a state that the junction tool 520 is fixed, the rod 540 starts descending this time and comes into contact with a top surface 528*a* of the partition section 528 provided in the junction tool 520, whereby the lowermost limit is defined.

Also, since the assembling method of this embodiment differs from those of other embodiments, it will be described.

First, the rod 540 is housed in the sliding cylinder 570 in a state that the through projection 542 of the rod 540 is engaged with the slit 571 of the sliding cylinder 570, and the rod 540 is inserted from an upper part of the junction tool 520 while spirally engaging the through projection 542 with the second spiral groove 525. Further, the front cylinder 550 is rotatably put in the junction tool 520, which completes a cosmetic container 501.

Figure 13:
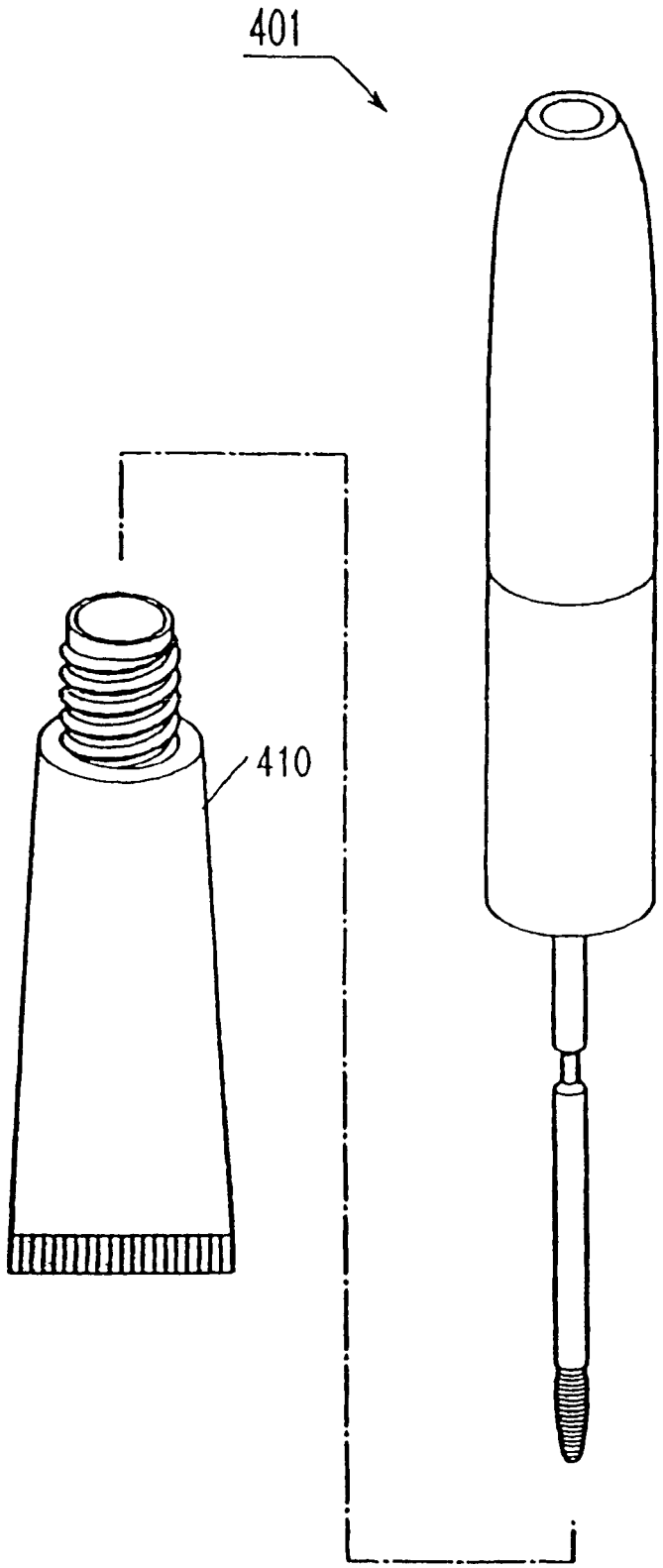
FIG. 13 is an assembly perspective view showing a cosmetic container according to a sixth embodiment of the present invention.

What is shown in FIG. 13 is a sixth embodiment of the present invention, and a cosmetic container 401 according to this embodiment is presented on the assumption that mascara and eyeliner or eyebrow pencil are contained.

This embodiment is mainly characterized in that a tube type container body 410 is not a blow molding cylindrical body which is used in the embodiments described above, but a soft tube type.

Since such a tube type container is cheaper than a container which is a cylindrical body and easy to manufacture, it is possible to apply excellent functions of the present invention not only to an expensive commodity which is sold at exclusive stores, but also to a cheap commodity. Each member provided at an upper part of the tube type container body 410 can be used in any one of the embodiments described above, and also the cosmetic container according to this embodiment can be applied to several combinations of mascara and eyeliner, lipliner and lip-gross, and the like.

As described in each embodiment, the cosmetic container according to the present invention can be used as a feeding container for a wide stick type cosmetic material regardless of the shape of a stick type cosmetic material retaining section and the classification of a sliding mechanism or a feeding mechanism. For example, it is also preferable that the second fitting concave annular section which makes the front cylinder rotatable is used, the inside of the front cylinder is rendered non-circular, and the shape of a rod front part retaining section is made applicable.

Further, for example, if the first spiral groove 21 and the second spiral groove 25 are formed in an identical direction so that when the junction tool 20 is rotated clockwise with respect to the container body 10 shown in FIG. 1, a closed state is realized and when the front cylinder 50 is rotated clockwise with respect to the junction tool 20, the stick type cosmetic material (A) is pulled in, pulling of the stick type cosmetic material (A) and sealing of the liquid cosmetic (B) can simultaneously be carried out in a single movement by rotating the front cylinder 50 clockwise with the container body 10 being fixed, for example, after the stick type cosmetic material (A) and the liquid cosmetic (B) are used.

Further, it is also preferable to have such constitution that directions of the first spiral groove 21 and the second spiral groove 25 are first set to be reverse and when the junction tool 20 is rotated clockwise with respect to the container body 10, the container body 10 becomes a closed state, and further when the front cylinder 50 is rotated clockwise with respect to the junction tool 20, the stick type cosmetic material (A) is fed out, whereby the stick type cosmetic material (A) can be used. This constitution also makes it possible that when the junction tool 20 and the front cylinder 50 are rotated clockwise with respect to the container body 10, respectively, the liquid cosmetic (B) becomes a closed state, but the stick type cosmetic material (A) is fed out so as to be ready for use, whereas when the junction tool 20 and the front cylinder 50 are rotated counterclockwise, the stick type cosmetic material (A) is pulled in, but the liquid cosmetic (B) becomes an opened state so as to be ready for use, in other words, the stick type cosmetic material (A) or the liquid cosmetic (B) can be selected depending on a direction of rotation.

For example, users of an old age can be relieved if a closing direction and an opening direction are identical. However, if the stick type cosmetic material (A) can be used in one direction and the liquid cosmetic (B) can be used in the opposite direction, it will be preferable for young users because they can have the sensation of speed in handling.

Needless to say, user's attention may be called by changing colors of the container body 10, the junction tool 20, and the front cylinder 50.

As described above, depending on the relation between the first spiral groove 21 and the second spiral groove 25, user's feeling in handling can be varied and it is possible to provide a cosmetic container which can cope with the design or usage planned.

As described above, the cosmetic container according to the present invention has the following effects.

(1) By indirectly connecting, with the junction tool between, the front cylinder serving as a stick type cosmetic material feeding container provided on the upper side and the container body in which a liquid cosmetic is filled and which is provided on the lower side, the both which are made from different materials can be used with minimum members.

(2) The junction tool is used as a cap and an applicator for the container body and as a container body in which a feeding mechanism is housed for the front cylinder serving as a stick type cosmetic material feeding container. In other words, all the functions for the connection are contained in the junction tool.

(3) It is possible to realize further facilitation of manufacture and assembly by embedding a single member in the junction tool in order for the second spiral groove to be a separate member.

(4) Further, it is possible to seal the container body by partitioning the junction tool into the upper cavity section and the lower cavity section using the partition board.

(5) It is possible to provide a commodity with the wide range of prices by producing the container body by blow molding or producing the tube type container body.

(6) It is possible to set the directions of the first spiral groove and the second spiral groove of the junction tool according to the design, usage, or the like of the cosmetic container.

INDUSTRIAL APPLICABILITY

The present invention provides a cosmetic container which makes it possible to use both of a stick type cosmetic material and a liquid cosmetic.

What is claimed is:

1. A cosmetic container, comprising:

a container body in which a liquid cosmetic is filled, said container body having a mouth, and a male screw provided at the mouth;

a junction tool having a first spiral groove formed at a lower side thereof, and a second spiral groove provided at an upper side thereof, the first spiral groove being spirally engaged with the male screw provided at the mouth of the container body in such a manner that the first spiral groove can freely be attached and detached so that said junction tool freely opens or closes the container body;

a stick type pivot which is fixed to the junction tool, can be inserted into the container body, and has an applicator;

a front cylinder rotatably connected with the junction tool and having at its front end an opening hole through which a stick type cosmetic material penetrates;

a rod which has a retaining section for retaining a base end of the stick type cosmetic material slidably inserted in the front cylinder, said rod having a spiral section; and a feeding mechanism for moving the rod in an axial direction by rotations of the junction tool and the front cylinder, and including:

a spiral engagement mechanism constituted by spirally engaging the spiral section at the rod with the second spiral groove provided at the upper side of the junction tool; and a sliding mechanism for guiding the rod so that the rod cannot rotate, but can slide with respect to an inside of the front cylinder, wherein the second spiral groove on the upper side of the junction tool and the first spiral groove on the lower side of the junction tool are formed in such a manner that their spiral directions are identical.

2. A cosmetic container according to claim 1, wherein a first fitting section for connecting the stick type pivot is provided on the lower side of the junction tool and a second fitting section for rotatably connecting the front cylinder is provided on the upper side of the junction tool.

3. A cosmetic container according to claim 1, wherein a spiral body having the second spiral groove at its inner circumference is inserted and fixed to the upper part of the junction tool, and the spiral body and the spiral section of the rod are spirally engaged.

4. A cosmetic container according to claim 1, wherein a partition section for separating the junction tool into an upper cavity section and a lower cavity section is provided in the junction tool.

5. A cosmetic container according to claim 1, wherein a squeezing rubber which has a hole for squeezing a liquid cosmetic adhered to the applicator is provided at an entrance section of the container body.

6. A cosmetic container, comprising:

a container body in which a liquid cosmetic is filled, said container body having a mouth, and a male screw provided at the mouth;

a junction tool having a first spiral groove formed at a lower side thereof, and a second spiral groove provided at an upper side thereof, the first spiral groove being spirally engaged with the male screw provided at the mouth of the container body in such a manner that the first spiral groove can freely be attached and detached so that said junction tool freely opens or closes the container body;

a stick type pivot which is fixed to the junction tool, can be inserted into the container body, and has an applicator;

a front cylinder rotatably connected with the junction tool and having at its front end an opening hole through which a stick type cosmetic material penetrates;

a rod which has a retaining section for retaining a base end of the stick type cosmetic material slidably inserted in the front cylinder, said rod having a spiral section; and a feeding mechanism for moving the rod in an axial direction by rotations of the junction tool and the front cylinder, and including:

a spiral engagement mechanism constituted by spirally engaging the spiral section at the rod with the second spiral groove provided at the upper side of the junction tool; and a sliding mechanism for guiding the rod so that the rod cannot rotate, but can slide with respect to an inside of the front cylinder, wherein the second spiral groove on the upper side of the junction tool and the first spiral groove on the lower side of the junction tool are formed in such a manner that their spiral directions differ each other.

7. A cosmetic container according to claim 6, wherein a first fitting section for connecting the stick type pivot is provided on the lower side of the junction tool and a second fitting section for rotatably connecting the front cylinder is provided on the upper side of the junction tool.

8. A cosmetic container according to claim 6, wherein a spiral body having the second spiral groove at its inner circumference is inserted and fixed to the upper part of the junction tool, and the spiral body and the spiral section of the rod are spirally engaged.

9. A cosmetic container according to claim 6, wherein a partition section for separating the junction tool into an upper cavity section and a lower cavity section is provided in the junction tool.

10. A cosmetic container according to claim 6, wherein a squeezing rubber which has a hole for squeezing a liquid cosmetic adhered to the applicator is provided at an entrance section of the container body.

* * * * *